US006546223B2

(12) United States Patent
Kishino et al.

(10) Patent No.: US 6,546,223 B2
(45) Date of Patent: Apr. 8, 2003

(54) ELASTIC BODY, ROLLER, HEATING AND FIXING DEVICE, AND MANUFACTURING METHOD THEREFOR

(75) Inventors: Kazuo Kishino, Kanagawa (JP); Masaaki Takahashi, Kanagawa (JP); Hideo Kawamoto, Tokyo (JP); Osamu Soutome, Kanagawa (JP); Yuji Kitano, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/938,523

(22) Filed: Aug. 27, 2001

(65) Prior Publication Data

US 2002/0028736 A1 Mar. 7, 2002

(30) Foreign Application Priority Data

Sep. 1, 2000 (JP) ..... 2000-265671

(51) Int. Cl.[7] ..... G03G 15/20

(52) U.S. Cl. ..... 399/333; 29/895.32; 428/304.4; 492/46; 492/56; 521/56; 523/218

(58) Field of Search ..... 399/328, 331, 399/333; 492/46, 49, 53, 56; 29/895.3, 895, 895.32; 428/304.4, 315.5, 36.6, 36.8, 407; 521/56, 1, 59; 523/218, 219

(56) References Cited

U.S. PATENT DOCUMENTS

| | | | | |
|---|---|---|---|---|
| 5,246,973 A | | 9/1993 | Nakamura et al. | 521/54 |
| 5,319,427 A | | 6/1994 | Sakurai et al. | 399/333 |
| 5,420,679 A | | 5/1995 | Goto et al. | 399/335 |
| 5,538,677 A | | 7/1996 | Takahashi | 264/221 |
| 5,608,508 A | | 3/1997 | Kumagai et al. | 399/339 |
| 5,725,209 A | | 3/1998 | Takahashi et al. | 271/122 |
| 5,753,348 A | | 5/1998 | Hatakeyama et al. | 428/195 |
| 5,950,061 A | | 9/1999 | Ota et al. | 399/333 |
| 5,966,578 A | | 10/1999 | Soutome et al. | 399/333 |
| 6,078,780 A | | 6/2000 | Abe et al. | 399/328 |
| 6,117,257 A | | 9/2000 | Takahashi et al. | 156/86 |
| 6,261,214 B1 | * | 7/2001 | Meguriya | 492/56 |

FOREIGN PATENT DOCUMENTS

| | | | |
|---|---|---|---|
| JP | 03-100059 | * | 4/1991 |
| JP | 4-77315 | | 3/1992 |
| JP | 5-46041 | | 2/1993 |
| JP | 05-209080 | * | 8/1993 |
| JP | 08-012888 | * | 1/1996 |
| JP | 10-060151 | * | 3/1998 |
| JP | 2000-230541 | * | 8/2000 |

* cited by examiner

*Primary Examiner*—Sophia S. Chen
(74) *Attorney, Agent, or Firm*—Fitzpatrick, Cella, Harper & Scinto

(57) ABSTRACT

A roller has an elastic layer formed by curing a silicone rubber material containing at least expanded resin microballons, wherein, when the roller is placed in a vacuum chamber in which atmospheric pressure is reduced to 0.001 MPa or less over 2 minutes, the roller has a gas permeability indicating the recovery characteristic where an increased amount of the thickness of the elastic layer after 10 minutes from the start of evacuation is two-thirds or less of the maximum increased amount of thickness of the elastic layer during a 10 minute period from the start of evacuation. The elastic layer is formed by curing a silicone rubber material containing the expanded resin microballoons and has air void portions formed by breaking the resin microballoons and passages connecting the air void portions therebetween.

9 Claims, 4 Drawing Sheets

ELASTIC BODY, ROLLER, HEATING AND FIXING DEVICE, AND MANUFACTURING METHOD THEREFOR

BACKGROUND OF THE INVENTION

1. Field of the Invention

The present invention relates to elastic bodies, pressure rollers, and image heating and fixing devices for use in electrophotographic image forming apparatuses such as a copying machine and a laser beam printer, and to manufacturing methods therefor.

2. Description of the Related Art

Recently, in image heating and fixing devices for use in electrophotographic image forming apparatuses such as a copying machine and a laser beam printer, miniaturization of the device has been progressing, and concomitant with this trend, reduction of the pressure roller diameter used for the device has also been advancing. In order to ensure a nip width during fixation in compliance with a smaller pressure roller diameter, the hardness of an elastic layer covering the periphery of a core shaft of the pressure roller tends to be lower, and for example, as disclosed in Japanese Patent Publication No. 4-77315, an elastic layer formed of a porous elastic body (sponge rubber) has been frequently used in practice.

In addition, in the heating and fixing devices, a heating and fixing device, which does not perform a standby temperature control in order to conserve electrical power by improving heating efficiency, is increasingly used. When the amount of heat generated by a heater is efficiently applied to transfer paper, the heating efficiency of this type of device can be improved, and hence, improvement of the heat insulating property of a pressure roller has been tried. For example, in Japanese Patent Laid-Open No. 5-46041, a hollow pressure roller has been proposed which is supported by a shaft and is a rotatable roller having an air layer therein.

Among these rollers described above, in order to smoothly release toner therefrom, a roller provided with a fluorinated resin tube on the periphery thereof and a roller coated with a fluorinated resin have been known.

As a method for manufacturing a sponge rubber, a method using resin microballoons has been proposed. For example, as disclosed in Japanese Patent Laid-Open Nos. 8-12888 and 5-209080, unexpanded microballoons are compounded with a rubber and are then heated, so that expansion of the resin microballoons and curing of the rubber are simultaneously performed.

In addition, as a method for solving a problem (nonuniform cells) encountered in the method described above, a method has been proposed in Japanese Patent Laid-Open No. 10-060151 in which resin microballoons expanded beforehand are compounded with a liquid rubber compound, and the liquid rubber compound is molded at a temperature not more than a melting temperature of the resin forming the microballoons so as to obtain a crosslinked rubber material.

It may be easily considered that resin balloons and a silicon rubber are used for forming a sponge elastic layer of the pressure roller, and in the case described above, as disclosed in the conventional example described above, resin microballoons expanded beforehand are suitably used.

In a conventional method for manufacturing the sponge rubber using the resin microballoons expanded beforehand, for example, unexpanded microballoons (fine hollow balls), each having an outer shell formed of a thermoplastic resin and containing isobutane or the like therein, are expanded to have a predetermined diameter and are then compounded with a rubber material, and subsequently, the rubber material is vulcanized at a temperature below a melting temperature of the resin forming the microballoons, whereby a rubber (hereinafter referred to as "microsponge rubber" in some cases) containing stable microballoons, i.e., microballoons having uniform diameters even after the vulcanization, is obtained.

However, when the microsponge rubber described above is used for forming a pressure roller, since the elastic layer (microsponge rubber) is formed of closed cells, the air permeability of the roller is low, and as a result, problems may occur in some cases in that the outside diameter of the roller changes with an increase in roller temperature while the roller is used, the processing speed thereof changes, and expansion and shrinkage of an image on a recording material may occur.

SUMMARY OF THE INVENTION

Accordingly, an object of the present invention is to provide a pressure roller comprising an elastic layer formed by curing a silicone rubber material containing at least expanded resin microballoons, in which the change in outside diameter of the roller caused by an increase in roller temperature during operation is small, and is to provide a heating and fixing device which can maintain a stable processing speed.

A roller in accordance with one aspect of the present invention comprises a supporting body, an elastic layer provided on the supporting body, in which the elastic layer comprises a silicone rubber formed by curing a silicone rubber material containing at least expanded resin microballoons. The roller described above has a gas permeability indicating the recovery characteristic where, when the roller is placed in a vacuum chamber in which atmospheric pressure is reduced to 0.001 MPa or less over 2 minutes, an increased amount of the thickness of the elastic layer after 10 minutes from the start of evacuation is two-thirds or less of the maximum increased amount of the thickness of the elastic layer during a 10 minutes period from the start of evacuation.

In the roller described above, the elastic layer preferably comprises air void portions (hereinafter referred to as "microballoon air void portions" in some cases) formed by breaking the resin microballoons and passages which are formed by evaporation of a volatile component contained in the silicone rubber material and which connect the air void portions therebetween. A cured silicone rubber material, which contains microballoon air void portions connected to each other via passages, has a superior gas permeability.

As the volatile component which connects the microballoon air void portions therebetween, a material having a good affinity to the expanded resin microballoon and a poor affinity to the silicone rubber is preferably used, and in addition, a material is preferably used which evaporates at a temperature not less than a softening temperature or a melting temperature of the resin for forming the resin microballoons. The volatile component is preferably at least one selected from the group consisting of ethylene glycol, diethylene glycol, triethylene glycol, and glycerin.

In addition, the silicone rubber material may be an addition type liquid silicone rubber material, and a cured product of the addition type liquid silicone rubber material is preferably processed at a temperature of 200° C. or more so as to break substantially every microballoon shape formed by the resin and to ideally form passages which connect the air void portions therebetween.

In accordance with another aspect of the present invention, a heating and fixing device comprises a fixing member having heating means for heating and fixing an unfixed toner image on a recording material and a pressure member for pressing the recording material against the heating means, wherein the pressure means is the roller described above.

In accordance with another aspect of the present invention, an elastic body comprises a silicone rubber formed by curing a silicon rubber material containing at least expanded resin microballoons, wherein air void portions formed by breaking the resin microballoons are connected to each other by passages. In the elastic body described above, the inside diameter of the passage connecting the air void portions therebetween is preferably in the range of ⅓ to 1/30 of the inside diameter of the air void portion. A roller comprising an elastic layer formed of the elastic body described above on a supporting body is preferably used as a pressure roller.

In addition, in accordance with another aspect of the present invention, a method for manufacturing a silicone rubber roller comprises a step of preparing a metal shaft, a silicone rubber material, expanded resin microballoons which have outer shells composed of a thermoplastic resin and which form air void portions, and a volatile component which is evaporated to connect the air void portions therebetween; a step of compounding the silicone rubber material, the expanded resin microballoons, and the volatile component for forming a compound; a step of performing heat curing of the compound at a temperature not more than a softening temperature of the thermoplastic resin to form the cured compound on the metal shaft; and a step of heating the cured compound at a temperature not less than the softening temperature of the thermoplastic resin to break the expanded resin microballoons and to evaporate the volatile component so as to form air void portions connected to each other.

The heat insulating pressure roller according to the present invention comprises the silicone rubber formed by using the resin microballoons and is used in the heating and fixing device of the electrophotographic image forming apparatus. In the pressure roller described above, since the air voids in the elastic layer are increasingly formed into open cells, the air permeability of the roller is high, and hence, the change in outer diameter thereof is small with an increase in temperature of the roller during operation. In addition, in the heating and fixing device provided with the pressure roller of the present invention, expansion and shrinkage of an image on a recording material caused by the change in processing speed do not occur, whereby a stable image can be formed on the recording material. Furthermore, the present invention provides the method for manufacturing the roller described above and provides the elastic body having a small volume change caused by the change in temperature.

Further objects, features and advantages of the present invention will become apparent from the following description of the preferred embodiments with reference to the attached drawings.

DESCRIPTION OF THE PREFERRED EMBODIMENTS

A roller in accordance with one aspect of the present invention comprises at least an elastic layer which is provided on a supporting body and comprises a silicone rubber formed by curing a silicone rubber material containing at least expanded resin microballoons so as to have a specific gas permeability indicating the recovery characteristics of the roller. That is, when the roller described above is placed in a vacuum chamber in which atmospheric pressure is reduced to 0.001 MPa or less over 2 minutes, an increased amount of the thickness of the elastic layer after 10 minutes from the start of evacuation is two-thirds or less of the maximum increased amount of the thickness thereof during a 10 minutes period from the start of evacuation.

The pressure roller comprises the supporting body and at least the elastic layer provided thereon and, in addition, may further comprise another layer, such as a releasing layer provided around the periphery of the roller for smoothly releasing toner therefrom.

Figure 1:
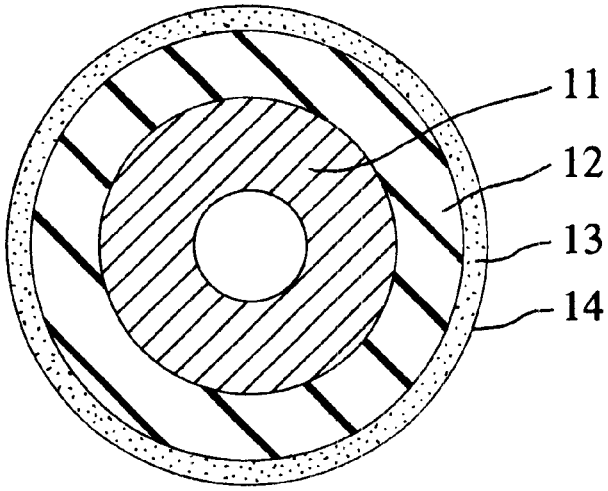
FIG. 1 is a schematic cross-sectional view of a pressure roller according to an embodiment.

FIG. 1 is a schematic cross-sectional view showing an example of a heat insulating pressure roller of the present invention. Reference numeral 11 indicates a core shaft composed of iron, aluminum, or the like, and around the core shaft 11, an elastic layer 12 formed of a silicone sponge rubber formed by curing a silicone rubber material containing expanded resin balloons, an adhesive layer 13, and a fluorinated resin layer 14 composed of polytetrafluoroethylene (PTFE), a copolymer of tetrafluoroethylene and perfluoro(alkyl vinyl)ether (PFA), a copolymer of tetrafluoroethylene and hexafluoropropylene (FEP), or the like as a releasing layer are sequentially formed.

The supporting body of the present invention is not specifically limited as long as it can be used as the supporting body for the pressure roller for use in an electrophotographic image forming apparatus, and a core shaft composed of aluminum or iron is a typical example. In addition, the releasing layer is not specifically limited in the present invention, and for example, it may be formed of a fluorinated resin tube or a coating layer of a fluorinated resin.

The expanded resin microballoons are compounded with a rubber material in order to decrease the thermal conductivity of the pressure roller. By increasing the heat insulating property of the pressure roller for use in a heating and fixing device, the amount of heat generated by a heater can be efficiently applied to transfer paper, and hence, electrical power conservation can be achieved in the heating and fixing device. The thermal conductivity of the elastic layer is preferably 0.15 W/m.sec or less.

As the expanded microballoons of the present invention, non-expanded resin microballoons each having an outer shell formed of a thermoplastic resin and containing a volatile material therein may be used after they are expanded by heating.

As the thermoplastic resin, a copolymer of vinylidene chloride and acrylonitrile, a copolymer of methyl methacrylate and acrylonitrile, and a copolymer of methacrylonitrile and acrylonitrile may be mentioned by way of example, and as the volatile material contained in the microballoon, for example, a hydrocarbon such as n-butane or isobutane may be mentioned.

As the thermoplastic resin used for forming the outer shell, a thermoplastic resin having a softening temperature in an appropriate range may be selected in consideration of a curing temperature of a silicone rubber material. In addition, it is preferable that the softening temperature of the thermoplastic be at least not less than a curing temperature of a silicone rubber material. When the curing temperature is not less than the softening temperature, the breakage of the resin microballoons may occur before the curing reaction of the silicone rubber material is completed, and as a result, a uniform sponge state may not be obtained in some cases. In general, the softening temperature is preferably in the range of 130 to 170° C.

As the expanded resin microballoons and the non-expanded resin microballoons, commercially available "Matsumoto Microsphere-F" series manufactured by Matsumoto Yushi-Seiyaku Co., Ltd. and "Expancel" manufactured by Expancel Co. may be used. These commercially available non-expanded resin microcapsules generally have a diameter of approximately 1 to 50 μm, and these microcapsules can be expanded into a nearly true spheric form approximately 10 to 500 μm in diameter by. heating to an appropriate temperature.

The average diameter of the resin microballoon expanded by heating is preferably in the range of 100 to 200 μm. When the average diameter of the resin microballoon expanded by heating is 100 μm or less, it is disadvantageous since a large amount of the microballoons must be compounded with a silicone rubber material in order to obtain a sufficient heat insulating property required for the heat insulating pressure roller. In contrast, when the microballoon having an average diameter of more than 200 μm is used, it is disadvantageous since a problem of an insufficient mechanical strength of the elastic layer may occur in some cases.

The average diameter described above is the average of ten data values, (a major axis+a minor axis)/2, obtained from 10 microballoons randomly selected among microballoons viewed by a microscope. The expanded resin microballoons having the diameter in the range described above can impart a sufficient heat insulating property to the pressure roller even when a small amount of the microballoons is contained therein, and in addition, compounding and mixing with a silicone rubber material can be easily performed.

The amount of the expanded microballoons is determined in accordance with a desired heat insulating property, and in general, 1 to 10 parts by weight of the microballoons to 100 parts by weight of a silicone rubber material is preferable. When the amount of the microballoons is less than 1 part by weight, it is disadvantageous since it is difficult to obtain a sufficient heat insulating property required for the heat insulating pressure roller, and when the amount is more than 10 parts by weight, it is disadvantageous since it becomes difficult to perform compounding and mixing of a silicone rubber material and the microballoons due to an increase in viscosity of the mixture thereof.

The silicone rubber material of the present invention is not specifically limited as long as it can achieve the objects of the present invention.

The air permeability of the pressure roller can be measured by the change in outer diameter of the pressure roller when it is placed in an evacuated state. When a pressure roller having a low air permeability is placed in an evacuated state, the roller is expanded, and.the increase in outer diameter thereof is maintained for a long time since a gas inside the roller slowly escapes therefrom. In the case in which the pressure roller has a high air permeability, the outside diameter thereof is first increased; however, the outside diameter is then decreased rapidly since a gas inside the roller is allowed to rapidly escape therefrom. The pressure roller having a low air permeability is directly influenced by the thermal expansion of the gas therein, and hence, the change in outside diameter of the pressure roller caused by the change in ambient temperature is significant.

In order to suppress the change in outer diameter so that the pressure roller can be used in practice without causing problems, it is necessary that when the pressure roller is placed in a vacuum chamber in which atmospheric pressure can be reduced to 0.001 MPa over 2 minutes, the pressure roller must have a specific air permeability indicating the recovery characteristics where an increased amount of the thickness of the elastic layer after 10 minutes from the start of evacuation is two-thirds or less of the maximum increased amount of the thickness thereof during a 10 minutes period from the start of evacuation.

Next, the measurement method of the gas permeability of the present invention will be described. A pressure roller is placed in a vacuum chamber, the pressure inside the chamber is decreased to 0.001 MPa or less over 2 minutes from the start of evacuation, and subsequently, a pressure of 0.001 MPa or less is maintained for ten minutes from the start of evacuation. In the steps described above, the thickness of the elastic layer is measured before evacuation and during a 10 minutes period from the start of evacuation.

The difference between the thicknesses of the elastic layer before and after evacuation, i.e., an increased amount of the thickness thereof, is represented by $\Delta t$. From the measurement result of the thickness of the elastic layer, a maximum increased amount $\Delta t(max)$ during a 10 minutes period and an increased amount $\Delta t(10)$ after 10 minutes from the start of evacuation can be obtained. The ratio of $\Delta t(10)$ to $\Delta t(max)$, that is, $\Delta t(10)/\Delta t(max)$, is a measure of the gas permeability of the present invention. In the present invention, the ratio is two-thirds or less. When the ratio is more than two-thirds, since the gas permeability is not satisfactory, the change in outer diameter of the roller is large due to the change in temperature caused by practical operation of the roller, and as a result, expansion and shrinkage of an electrophotographic image on a recording material may occur.

The vacuum chamber is not specifically limited as long as this measurement can be performed therein.

Figure 2:
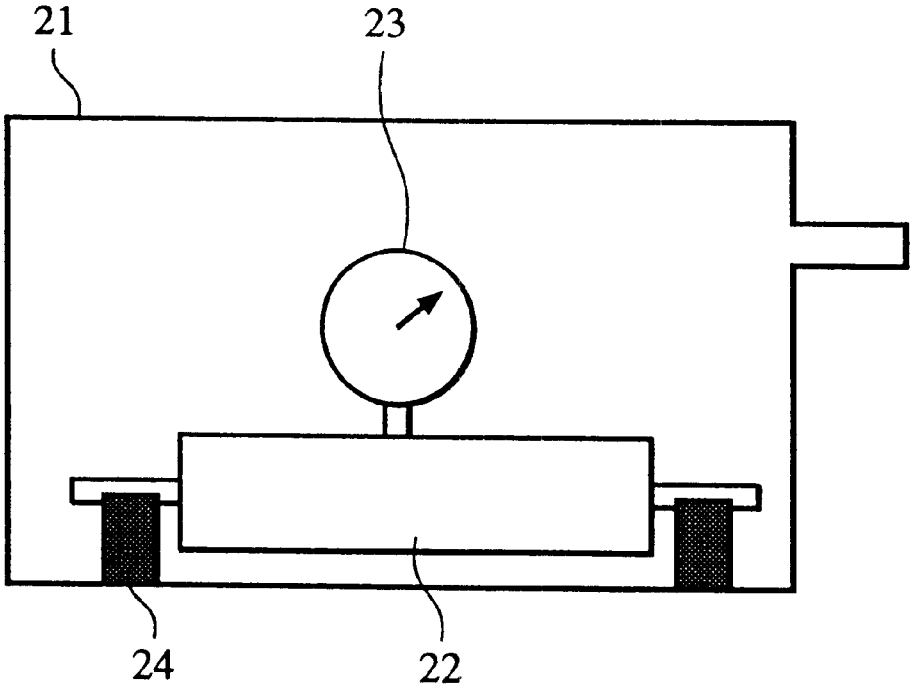
FIG. 2 is a schematic view showing a device for measuring the gas permeability of a pressure roller.

FIG. 2 is a schematic view showing an example of a device for measuring the gas permeability. Reference numeral 21 indicates a vacuum chamber formed of an acrylic resin or the like, reference numeral 23 indicates a dial gage, reference numeral 24 indicates a supporting table for receiving a pressure roller 22 thereon. The dial gage 23 can measure the change in thickness of the elastic layer of the roller. In this measurement method, the total thickness of the roller including layers other than the elastic layer is measured; however, in general, the thicknesses of the layers other than the elastic layer do not change by evacuation.

In the roller of the present invention described above, the silicone rubber material may contain a volatile component, and the elastic layer of the roller preferably comprises air void portions (hereinafter referred to as "microballoon air void portions" in some cases) formed by breaking the resin microballoons and passages which are formed by evaporation of the volatile component and which connect the air void portions therebetween.

In the heat insulating pressure roller composed of the silicone rubber of the present invention described above, the volatile component is preferably at least one compound selected from the group consisting of ethylene glycol, diethylene glycol, triethylene glycol, and glycerin.

These ethylene glycol, diethylene glycol, triethylene glycol, and glycerin are compounds each having good affinity to the expanded resin microballoons, and it has been believed that each of these compounds effectively covers the surfaces of the resin microballoons compounded with the silicone rubber material and serves to facilitate the formation of open cells in the silicone rubber containing the resin microballoons.

The amount of the volatile component compounded in the silicone rubber material, as the total of ethylene glycol, diethylene glycol, triethylene glycol, and glycerin, is preferably one to two times (on part by weight basis) the amount of the resin microballoons. When the amount is less than that mentioned above, it is disadvantageous since the effect described above cannot be obtained, and when the amount is more than that, it is also disadvantageous since the curing and heat-resistant properties of the silicone rubber may be degraded in some cases.

In order to compound the resin balloons and at least one of ethylene glycol, diethylene glycol, triethylene glycol, and glycerin with a silicone rubber material, the silicone rubber material is preferably in a liquid form in view of the workability thereof during compounding and mixing.

Types or the like of liquid silicone rubber material used in the present invention is not specifically limited as long as the material is in a liquid form at room temperature and is formed into a silicone rubber having rubber elasticity by heat curing. As the liquid silicone rubber material described above, for example, there may be mentioned an addition reaction curable liquid silicone rubber material which is composed of a diorganopolysiloxane containing alkenyl groups, an organohydrogenpolysiloxane containing hydrogen atoms bonded to silicon atoms, and a reinforcing filler, and which is formed into a silicone rubber by curing using a platinum-based catalyst; an organic peroxide curable liquid silicone rubber material which is composed of a diorganopolysiloxane containing alkenyl groups and a reinforcing filler, and which is formed into a silicone rubber by curing using an organic peroxide compound; and a condensation reaction curable liquid silicone rubber material which is composed of a diorganopolysiloxane containing hydroxyl groups, an organohydrogenpolysiloxane containing hydrogen atoms bonded to silicon atoms, and a reinforcing filler, and which is formed into a silicone rubber by curing using a catalyst, such as an organic tin compound, an organic titanium compound, or a platinum-based catalyst, for facilitating a condensation reaction. Among these described above, in view of rapid curing rate and superior uniformity of the cured material, an addition reaction curable liquid silicone rubber material, that is, an addition type liquid silicone rubber material, is particularly preferable.

In order to obtain a cured material having a rubber elasticity, a silicone rubber material which is primarily composed of a linear diorganopolysiloxane and has a viscosity of 100 centipoise or more at 25° C. is preferably used in view of the mechanical strength of the cured material.

To this liquid silicone rubber material, as long as the objects of the present invention can be satisfactory achieved, a pigment, a heat-resistant improver, a flame retardant, a plasticizer, an adhesion improver, or the like may be added when necessary in addition to various fillers for adjusting the fluidity or for improving the mechanical strength of the cured material.

The amount of the expanded microballoons is determined in accordance with a desired heat insulating property, and in general, 1 to 10 parts by weight of the microballoons to 100 parts by weight of a liquid silicone rubber material is preferable. When the amount of the microballoons is less than 1 part by weight, it is disadvantageous since it is difficult to obtain a satisfactory heat insulating property required for the heat insulating pressure roller, and when the amount is more than 10 parts by weight, it is also disadvantageous since it becomes difficult to perform compounding and mixing of the silicone rubber material and the microballoons due to an increase in viscosity of the mixture thereof.

A heat curing temperature is generally set in the range of 100 to 200° C., and it is preferable that the heat curing temperature be at least not more than a softening temperature of resin balloons. When the heat curing temperature is higher than the softening temperature, the breakage of the resin balloons may occur before the curing reaction of the silicone rubber material is completed, and as a result, a uniform sponge state may not be obtained in some cases. When the heat curing temperature is significantly lower than the softening temperature, resin balloons in the form of a closed cell remain, and hence, a high gas permeability may not be obtained in some cases. In view of the situation described above, in particular, the heat curing temperature is preferably determined so as to satisfy the equation, (a softening temperature of the resin for forming balloons)−30° C.<(a heat curing temperature)<(a softening temperature of the resin for forming balloons).

In the roller described above of the present invention, it is preferable that the silicone rubber material be an addition type liquid silicone rubber material, and that the silicone rubber obtained therefrom be preferably processed by heat treatment at 200° C. or more.

Figure 4A:
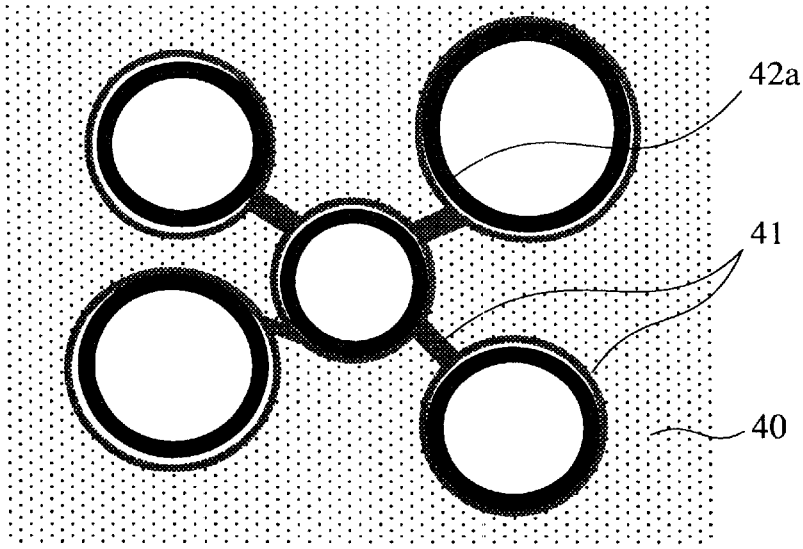
FIG. 4A is a schematic view showing a step of forming open cells.
Figure 4B:
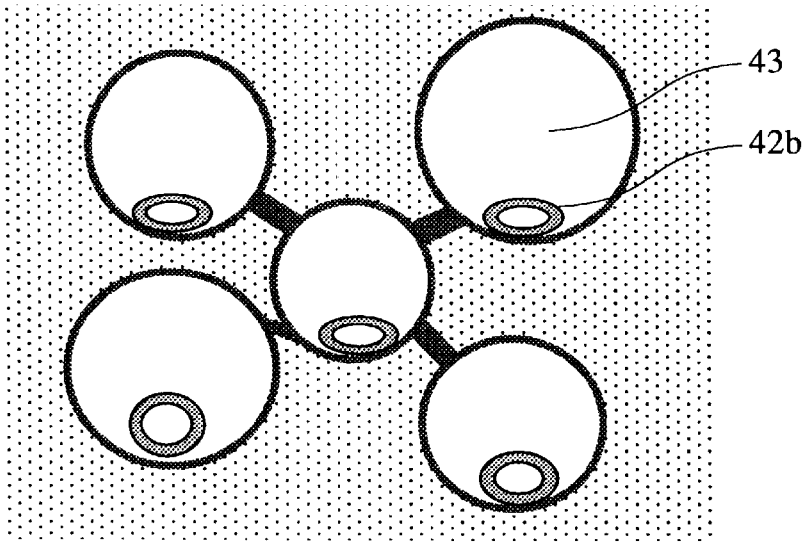
FIG. 4B is a schematic view showing a step of forming open cells.
Figure 4C:
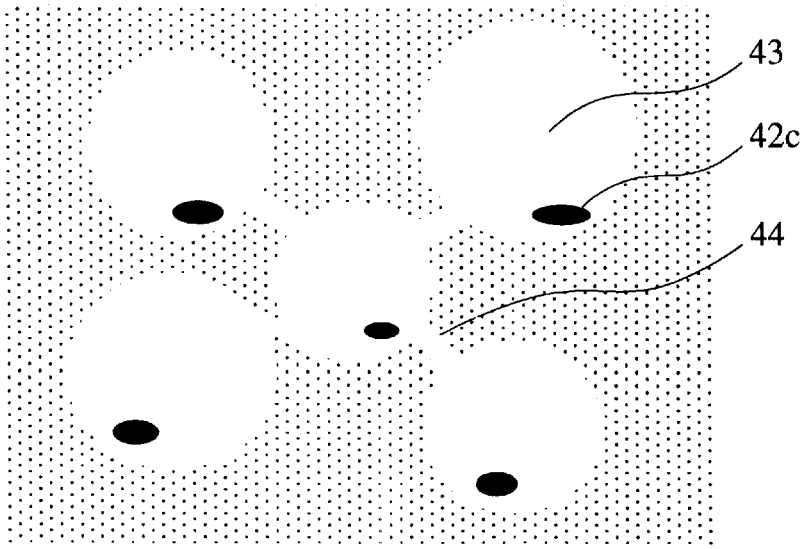
FIG. 4C is a schematic view showing a step of forming open cells.

Probable steps of forming open cells according to the present invention will be described with reference to schematic views (FIGS. 4A to 4C). FIG. 4A is a view showing an elastic layer before a silicone rubber is formed by heat curing. A material used as a volatile component 41 for forming passages which connect the microballoon air void portions therebetween is required to have a superior affinity to a resin microballoon 42*a* and an inferior affinity to a silicone rubber material 40. It is believed that the volatile component efficiently covers the surfaces of the resin balloons in the silicone rubber material compounded with the resin balloons. In addition, an excessive amount of the volatile component connects the balloons with each other. FIG. 4B is a view showing a state of a cured silicone rubber material. The surfaces of the resin balloons and the walls of the silicone in contact thereto are likely to separate from each other during heat curing of the silicone rubber material, and hence, shrinkage or breakage of the resin balloons easily occurs, thereby forming microballoon air void portions 43. In the figure, reference numeral 42*b* indicates a broken and shrunk resin shell which previously formed the resin balloon. In the step described above, it is believed that a part of the volatile component is evaporated so that open cells are formed in a part of the silicone rubber containing the resin balloons. FIG. 4C is a view showing a silicone rubber processed by heat treatment. After heat curing is performed, when heat treatment is further performed, remaining resin balloons are broken so as to facilitate the formation of air voids while the air void portions 43 maintains its balloon shape, and the component for forming passages is simultaneously evaporated, whereby the formation of passages 44 connecting the microballoon air void portions to each other is facilitated. Hence, it is believed that the formation of open cells is further facilitated. In the figure, reference numeral 42*c* indicates a further broken and shrunk resin shell which previously formed the resin balloon.

Figure 5:
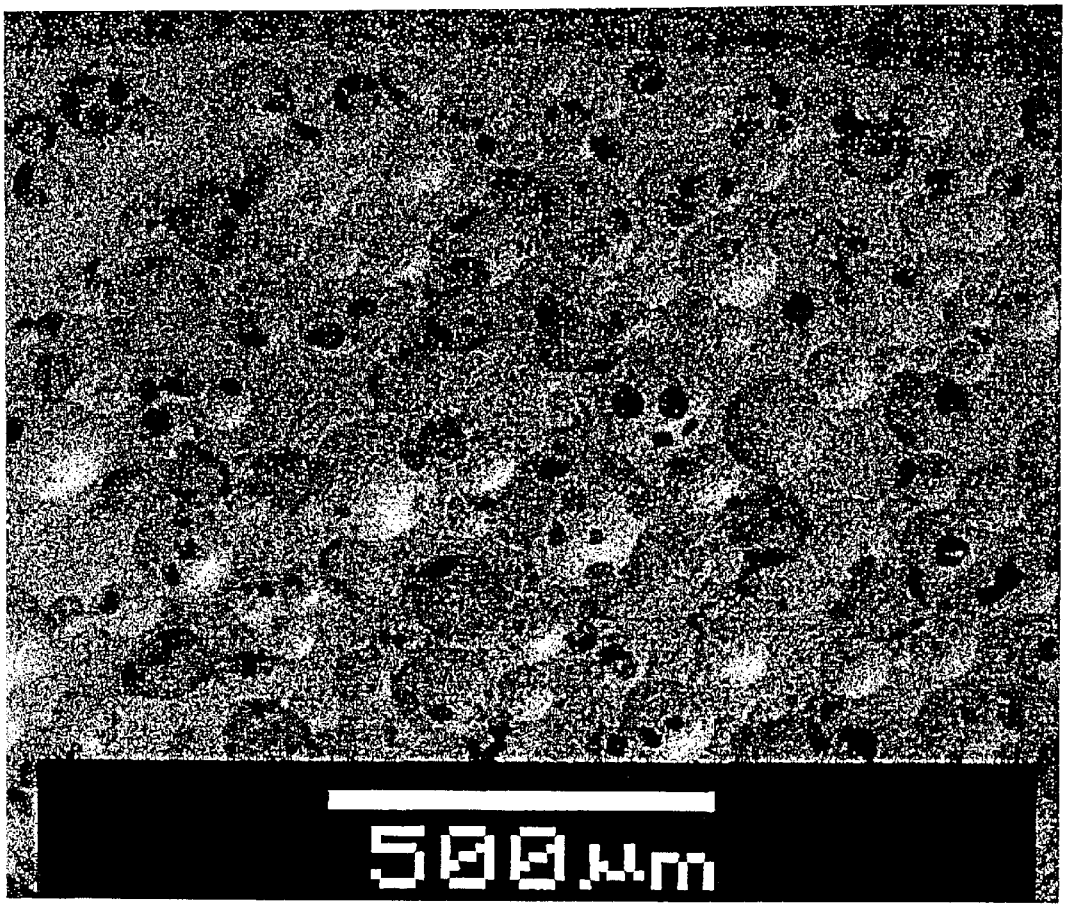
FIG. 5 is a SEM photo showing a cross-section of a cured material having open cells.

FIG. 5 is a SEM photo showing a cross-sectional portion of a cured material containing open cells. In the balloon air void portions, cross-sections of the passages can be observed. In the figure, a small black spot indicates the cross-section of the passage, and a large round spot indicates the balloon air void portion.

As described above, by performing heat treatment at 200° C. or more, the formation of open cells in the silicone rubber containing the resin balloons can be facilitated. The heat treatment may be performed in the range of 200 to 300° C. so as not to degrade the silicone rubber containing the resin balloons.

A heating and fixing device in accordance with another aspect of the present invention comprises a fixing member provided with heating means for heating and fixing an unfixed toner image on a recording material, and a pressure member for pressing the recording member against the heating means, wherein the pressure member comprises the roller described above.

The heating means and the fixing member are not specifically limited as long as they can be used as heating means and a fixing member for use in an electrophotographic image forming apparatus. As a typical example of the heating means, a ceramic heater may be mentioned. As the fixing member, a fixing film or a fixing roller may be mentioned by way of example.

In the elastic body of the pressure roller according to the present invention, since the formation of air voids in the form of an open cell is facilitated so that the air permeability is high, the change in outer diameter of the roller caused by an increase in temperature thereof during operation is small, and expansion and shrinkage of an image on a recording material caused by the change in processing speed do not occur, whereby a stable image can be formed on a recording material.

Figure 3:
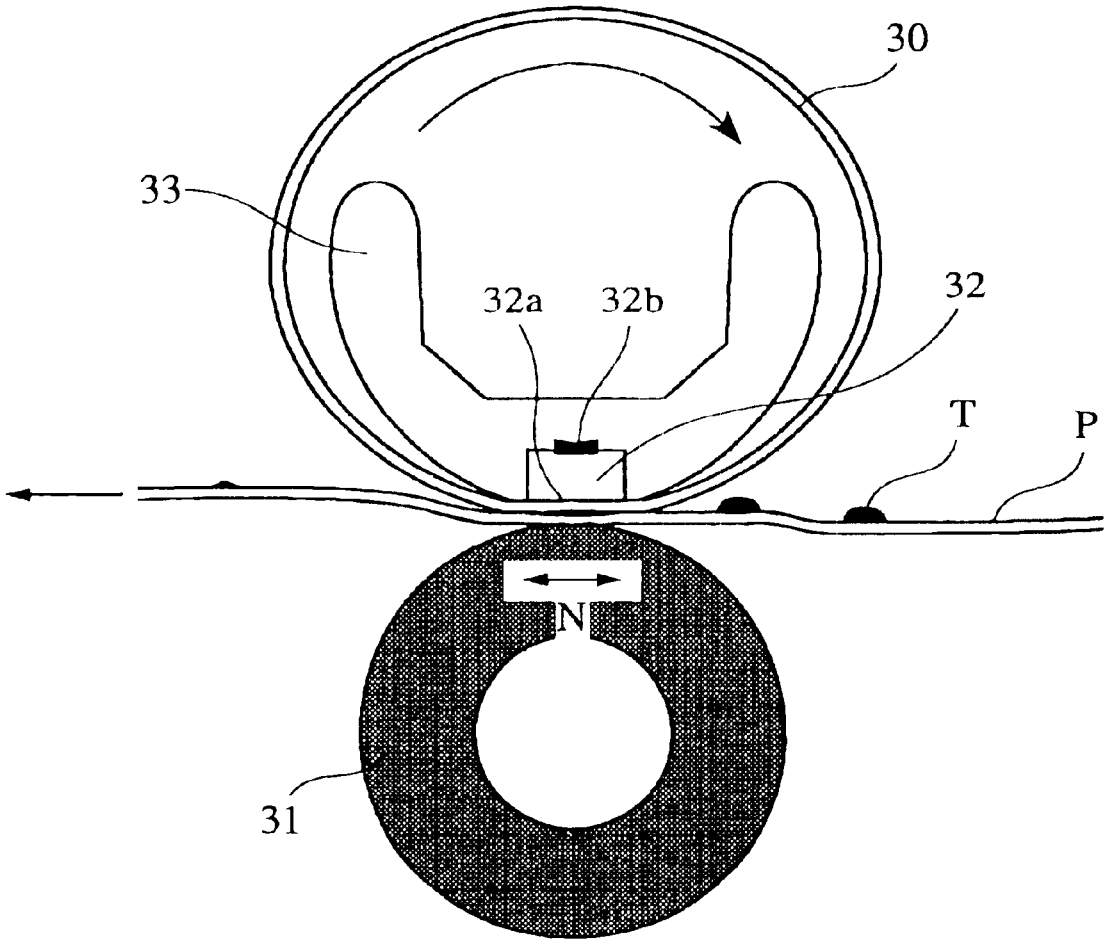
FIG. 3 is schematic cross-sectional view of a film-heating type fixing device of an embodiment.

FIG. 3 is a schematic cross-sectional view showing a film-heating type fixing device as an example of a fixing device of the present invention.

In FIG. 3, reference numeral 30 indicates a heat-resistant film (fixing film) in the form of an endless belt, and the heat-resistant film 30 is loosely provided around a film guide member (stay) 33 in a semi-arc form. Reference numeral 31 indicates a pressure roller of the present invention.

In FIG. 3, when image fixing is performed, concomitant with the rotation of the pressure roller 31, the film 30 is rotationally driven at a predetermined peripheral velocity in the clockwise direction indicated by an arrow while the film 30 is in contact with the surface of a heater 32 and slides thereon. That is, the film 30 is rotationally driven without forming wrinkles thereon at the predetermined peripheral velocity which is approximately equal to a transfer speed of a transfer material P which carries an unfixed toner image T thereon and is transferred from an image forming portion (not shown). The length of the heater 32 is approximately equal to that of the film 30.

The heater 32 includes an electric heating element (resistance heating element) 32*a* which is a heating source generating heat by applying electricity thereto, and the temperature of the heater 32 is increased by the heat generated by the electric heating element 32*a*.

In order to perform a temperature control of the heater 32, electricity applied to the electric heating element 32*a* is controlled so that the temperature of the heater 32 determined by a temperature sensing element 32*b* is constant.

When this film-heating type fixing device placed under a room temperature condition is energized, the heater 32 is heated by applying electricity to the electric heating element 32*a,* and while the film 30 is rotationally driven, an application of the heat generated by the heater 32 to the pressure roller via the film 30 can be suppressed since this film-heating type fixing device is provided with the pressure roller of the present invention. Consequently, the heater 32 and the film 30 can be ready to perform fixation within a short period of time.

After the film-heating type fixing device is energized, an urged nip portion N (fixing nip portion) is formed between the heater 32 and the pressure roller 31 by an elastic force generated by the deformation of the elastic layer of the pressure roller 31, and the transfer material P is fed to the nip portion N described above, whereby the transfer material P in close contact and in conformity with the film 30 passes through the fixing nip portion N.

In the step in which the transfer material P passes through the fixing nip portion N, since thermal energy generated by the heater 32 is applied to the transfer material P via the film 30, the unfixed toner image T is heated, melted, and then fixed on the transfer material P. Subsequently, the transfer material P is separated from the film 30 after passing through the fixing nip and is then discharged.

In an elastic body formed by curing a silicone rubber material containing at least expanded resin microballoons in accordance with another aspect of the present invention, the elastic body comprises air void portions formed by breaking the resin microballoons and passages which connect the air void portions therebetween.

The elastic body of the present invention comprises the cured material having a high gas permeability, and accordingly, in addition to the pressure roller for use in the electrophotographic image forming apparatus, the elastic body may also be used for an element which is required to have a small change in volume thereof caused by the change in temperature.

In the elastic body described above, the inside diameter of the passage is preferably in the range of ⅓ to 1/30 of the inside diameter of the air void portion.

When the inside diameter of the passage is too large, it is disadvantageous in view of the mechanical strength of the cured material, and when the inside diameter is too small, it is also disadvantageous since a satisfactory gas permeability may not be obtained in some cases.

The inside diameter of the passage and the inside diameter of the air void portion of the microballoon are the average inside diameters thereof.

A roller in accordance with another aspect of the present invention comprises a supporting body and an elastic layer provided thereon, wherein the elastic layer comprises the elastic body described above.

A method for manufacturing a pressure roller of a silicone rubber in accordance with another aspect of the present invention comprises a step of preparing a metal shaft, a silicone rubber material, expanded resin microballoons which have outer shells composed of a thermoplastic resin and form air void portions, and a volatile component which is evaporated to connect the air void portions therebetween; a step of compounding the silicone rubber material, the expanded resin microballoons, and the volatile component for forming a compound, a step of performing heat curing of the compound at a temperature not more than a softening temperature of the thermoplastic resin to form the cured compound on the metal shaft; and a subsequent step of heating the cured compound at a temperature not less than the softening temperature of the thermoplastic resin to break the resin microballoons and to evaporate the volatile component so that the air void portions which are connected to each other are formed.

As has thus been described, the present invention provides the heat insulating pressure roller and the heating and fixing device for use in the electrophotographic image forming apparatus. The heat insulating pressure roller formed by curing the silicone rubber material containing the resin microballoons has a high gas permeability since the formation of air bubbles in the form of an open cell are facilitated in the elastic body composed of the silicone rubber, and as a result, the change in outer diameter of the roller caused by the change in temperature is small while the roller is operated. Consequently, in the heating and fixing device using the pressure roller described above, a problem of expansion and shrinkage of an image on a recording material does not occur which is caused by the change in processing speed, and hence, a stable image can be formed on the recording material.

EXAMPLES

First Example

First, expanded microballoons were prepared.

Unexpanded resin microballoons (Matsumoto Microsphere-F85, a particle diameter of 20 to 30 μm, a true specific gravity of 1.04, a softening point of wall of 150 to 155° C., manufactured by Matsumoto Yushi-Seiyaku Co., Ltd.) were dried in an oven at 90° C. for 1 hour.

After cooling, the microballoons were placed in an oven controlled at a temperature for expansion of 150° C. for 30 minutes, so that expanded resin microballoons having an average diameter of 108 μm were formed. The average diameter described above is the average of 10 data values, (major axis+minor axis)/2, obtained from 10 pieces microballoons randomly selected among microballoons viewed by a microscope.

A liquid silicone compound composed of 100 parts of an addition type liquid silicone rubber material (a viscosity of 130 Pa.s, a specific gravity of 1.17, DY35-561A/B manufactured by Dow Corning Toray Silicone Co., Ltd.), 3 parts by weight of the expanded resin microballoons, and 5 parts by weight of ethylene glycol was formed by compounding at room temperature for 10 minutes using a universal mixer (Dalton manufactured by Sanei Seisakusho Co., Ltd.). In the step described above, in order to prevent the expanded microballoons from being broken by heat, the microballoons are preferably mixed or compounded with the other materials at a temperature not more than a softening temperature of a resin forming the microballoons.

When the resin microballoon was expanded so that the average diameter was 108 μm, the bulk volume thereof was approximately 60 times the original bulk volume; however, problems caused by spreading of the expanded microballoons did not occur in subsequent measuring and mixing steps due to the adhesion of dimethylsilicone oil present on the surfaces of the expanded resin microballoons.

Next, the silicone rubber material was formed on a metal shaft by a known heat-curing method at a temperature not more than the temperature for expansion mentioned above. Means or a method for forming a roller by heat curing is not specifically limited; however, a method of forming a roller is simple and preferable which comprises steps of placing a metal shaft in a pipe-shaped mold having a predetermined inside diameter, injecting the silicone rubber material thereinto, and heating the mold. In the method described above, when the heat curing temperature is not less than the softening temperature of the resin microballoons, the balloons are deformed by heating, and as a result, microballoons having a uniform sponge shape may not be obtained in some cases.

In this example, after an aluminum shaft processed by primer treatment was placed in a pipe-shaped mold, the compound of the liquid silicone rubber material was injected in the mold and was then cured by heating using a hot plate controlled at a temperature of 130° C., and the cured silicone rubber formed thereby was then removed.

Subsequently, this cured silicone rubber was processed by heat treatment in an oven controlled at a temperature of 230° C. for 2 hours, thereby forming an elastic roller composed of the silicone rubber.

After primer treatment (using GLP103SR manufactured by Daikin Industries, Ltd.) was performed on the surface of the heat insulating elastic roller composed of the silicone rubber, spray coating of a fluorinated latex (GLS213 manufactured by Daikin Industries, Ltd.) was performed thereon, so that a layer approximately 30 μm thick was formed as a releasing layer. The elastic roller thus processed was dried at 70° C. and was then fired in an oven controlled at a temperature of 310° C. for 30 minutes, thereby forming a silicone rubber pressure roller having a rubber length of 225 mm, a rubber thickness of 2.5 mm, and an outside diameter of 20 mm.

This pressure roller was placed in an acrylic resin-made vacuum chamber having the structure shown in FIG. 2, and the chamber was evacuated by a vacuum pump connected thereto. The pressure was reduced to 0.001 MPa within approximately 1.5 minutes, and this pressure was then maintained. The change in thickness (an increased amount) became a maximum value of 110 μm after approximately 1 minute and was then decreased to 40 μm after 10 minutes from the start of evacuation.

Second Example

A pressure roller composed of a silicone rubber having a rubber length of 225 mm, a rubber thickness of 2.5 mm, and an outside diameter of 20 mm was formed in a manner equivalent to that in the first example except that a liquid silicone compound was used including 100 parts of an addition type liquid silicone rubber material (a viscosity of 130 Pa.s, a specific gravity of 1.17, DY35-561A/B manufactured by Dow Corning Toray Silicone Co., Ltd.), 4 parts by weight of the expanded resin microballoons, and 5 parts by weight of ethylene glycol.

This pressure roller was placed in a vacuum chamber, and the chamber was then evacuated by a vacuum pump connected thereto. The pressure was reduced to 0.001 MPa within approximately 1.5 minutes, and this pressure was then maintained. The change in thickness became a maximum value of 150 μm after approximately 1 minute and was then decreased to 70 μm after 10 minutes from the start of evacuation.

First Comparative Example

A pressure roller composed of a silicone rubber having a rubber length of 225 mm, a rubber thickness of 2.5 mm, and an outside diameter of 20 mm was formed in a manner equivalent to that in the first example except that a liquid silicone compound composed of 100 parts of an addition type liquid silicone rubber material (a viscosity of 130 Pa.s, a specific gravity of 1.17, DY35-561A/B manufactured by Dow Corning Toray Silicone Co., Ltd.), and 4 parts by weight of the expanded resin microballoons was used, in which no ethylene glycol is contained.

This pressure roller was placed in a vacuum chamber, and the chamber was then evacuated by a vacuum pump connected thereto. The pressure was reduced to 0.001 MPa within approximately 1.5 minutes, and this pressure was then maintained. The change in thickness became a maximum value of 250 μm after approximately 1.5 minutes, and this change was maintained, so that the change was still 250 μm after 10 minutes from the start of evacuation.

Experimental Example

Next, by using a heating and fixing device provided with the pressure roller of the first example or the second example and a heating and fixing device provided with the pressure roller of the first comparative example, images were actually formed on recording materials for evaluating the qualities thereof.

A film-heating type fixing device having the structure shown in FIG. 3 was prepared. A fixing film 30 was formed by applying a dispersion containing a fluorinated resin (a mixture of PTFE and PFA in a ratio of 50 to 50) to a seamless polyimide film 40 μm thick and 25 mm in outer diameter provided with a fluorinated primer 5 μm thick thereon followed by firing, and subsequently, a fixing film 230 m long was obtained by cutting.

As the pressure roller 31, the rollers formed in the first and second examples and in the first comparative examples were used sequentially for the experiments.

The film-heating type fixing device was assembled in a laser beam printer (Lasershot LBP350 manufactured by Canon K.K.), and a continuous printing test was performed. When an image on the first sheet and an image on the twentieth sheet were compared to each other, an image expansion of 0.1% or less was obtained by both pressure rollers formed in the first and the second examples, and on the other hand, the image expansion obtained by the pressure roller formed in the first comparative example was 0.6%.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A roller comprising:

a supporting body;

an elastic layer provided on the supporting body, the elastic layer comprising a silicone rubber formed by curing a silicone rubber material containing at least expanded resin microballoons;

wherein the roller has a gas permeability indicating the recovery characteristic where, when the roller is placed in a vacuum chamber in which atmospheric pressure is reduced to 0.001 Mpa or less over 2 minutes, an increased amount of the thickness of the elastic layer after 10 minutes from the start of evacuation is two-thirds or less of the maximum increased amount of the thickness of the elastic layer during a 10 minute period from the start of evacuation.

2. A roller according to claim 1, wherein the silicone rubber material contains a volatile component, and the elastic layer comprises air void portions formed by breaking the resin microballoons and passages which are formed by evaporation of the volatile component and connect the air void portions therebetween.

3. A roller according to claim 2, wherein the volatile component is at least one selected from the group consisting of ethylene glycol, diethylene glycol, triethylene glycol, and glycerin.

4. A roller according to one of claims 1 to 3, wherein the silicone rubber material is an addition type liquid silicone rubber material, and the silicone rubber is processed by heat treatment at 200° C. or more.

5. A heating and fixing device comprising:

a fixing member comprising heating means for heating and fixing an unfixed toner image on a recording material; and a pressure member for pressing the recording material against the heating means;

wherein the pressure member comprises a roller according to one of claims 1 to 3.

6. An elastic body comprising a silicone rubber formed by curing a silicone rubber material containing at least expanded resin microballoons, comprising:

air void portions formed by breaking the resin microballoons; and passages which connect the air void portions therebetween.

7. An elastic body according to claim 6, wherein the diameter of the passages is in the range of ⅓ to 1/30 of the average diameter of the air void portions.

8. A roller comprising:

a supporting body; and an elastic layer provided on the supporting body;

wherein the elastic layer comprises an elastic body according to one of claims 6 and 7.

9. A method for manufacturing a silicone rubber roller comprising:

a step of preparing a metal shaft, a silicone rubber material, expanded resin microballoons which have outer shells composed of a thermoplastic resin and which form air void portions, and a volatile component which is evaporated to connect the air void portions therebetween;

a step of compounding the silicone rubber material, the expanded resin microballoons, and the volatile component for forming a compound;

a step of performing heat curing of the compound at a temperature not more than a softening temperature of the thermoplastic resin to form the cured compound on the metal shaft; and a step of heating the cured compound at a temperature not less than the softening temperature of the thermoplastic resin to break the expanded resin microballoons and to evaporate the volatile component so that the air void portions which are connected to each other are formed.

* * * * *

UNITED STATES PATENT AND TRADEMARK OFFICE

CERTIFICATE OF CORRECTION

PATENT NO. : 6,546,223 B2
DATED : April 8, 2003
INVENTOR(S) : Kazuo Kishino et al.

It is certified that error appears in the above-identified patent and that said Letters Patent is hereby corrected as shown below:

Title page,
Item [57], ABSTRACT,
Line 3, “microballons,” should read -- microballoons, --.

Column 2,
Line 42, “minutes” should read -- minute --.

Column 4,
Line 27, “minutes” should read -- minute --.

Column 5,
Line 28, “by.” should read -- by --.

Column 6,
Line 3, “and.the” should read -- and the --.
Line 19, “must” should be deleted.
Lines 23, 33 and 38, “minutes” should read -- minute --.

Column 7,
Line 67, “satisfactory” should read -- satisfactorily --.

Column 8,
Line 61, “shrunk” should read -- shrunken --.

Column 9,
Line 2, “maintains its” should read -- maintains their --.
Line 8, “shrunk” should read -- shrunken --.

Column 11,
Line 44, “pieces” should read -- pieces of --.

UNITED STATES PATENT AND TRADEMARK OFFICE

CERTIFICATE OF CORRECTION

PATENT NO. : 6,546,223 B2
DATED : April 8, 2003
INVENTOR(S) : Kazuo Kishino et al.

It is certified that error appears in the above-identified patent and that said Letters Patent is hereby corrected as shown below:

Column 13,
Line 32, “m” should read -- mm --.
Line 58, “body;” should read -- body; and --.
Line 63, “microballoons;” should read -- microballoons, --.

Column 14,
Line 26, “means;” should read -- means, --.
Line 41, “body;” should read -- body, --.

Signed and Sealed this

Seventh Day of October, 2003

JAMES E. ROGAN
*Director of the United States Patent and Trademark Office*